US007871180B2

(12) United States Patent
Wu et al.

(10) Patent No.: US 7,871,180 B2
(45) Date of Patent: Jan. 18, 2011

(54) STRUCTURE OF LIGHTING BAR ASSEMBLY

(75) Inventors: Chih-Hsien Wu, San Chung (TW); Ching-Li Chou, San Chung (TW)

(73) Assignee: Unity Opto Technology Co., Ltd., Taipei Hsien (TW)

( * ) Notice: Subject to any disclaimer, the term of this patent is extended or adjusted under 35 U.S.C. 154(b) by 246 days.

(21) Appl. No.: 12/292,294

(22) Filed: Nov. 17, 2008

(65) Prior Publication Data

US 2010/0124053 A1 May 20, 2010

(51) Int. Cl.
*F21S 4/00* (2006.01)

(52) U.S. Cl. ..... 362/219; 362/217.13

(58) Field of Classification Search ..... 362/219, 362/217.01, 221, 225, 217.13
See application file for complete search history.

(56) References Cited

U.S. PATENT DOCUMENTS 7,049,761 B2 * 5/2006 Timmermans et al. ..... 315/246
2005/0265019 A1 * 12/2005 Sommers et al. ..... 362/217
2007/0133202 A1 * 6/2007 Huang et al. ..... 362/235
2007/0183156 A1 * 8/2007 Shan ..... 362/277

* cited by examiner

*Primary Examiner*—David V Bruce
(74) *Attorney, Agent, or Firm*—Rosenberg, Klein & Lee

(57) ABSTRACT

A lighting bar assembly includes at least two lighting bar and at least one connector. Each lighting bar of the at least two lighting bars includes an enclosure, a circuit board, at least one power supply device, four male terminals, and two end caps. The enclosure is coupled to the circuit board. The circuit board includes a plurality of light-emitting diodes. The enclosure forms an interior space receiving the at least one power supply device. Each male terminal, the at least one power supply device and the circuit board are in electrical connection with one another. Opposite ends of the enclosure are respectively closed by the two end caps with the two end caps being in tight engagement with the enclosure. Each end cap forms a connection window in which the at least one connector is fit into the connection windows of the end caps. As such, advantages of easy manufacturing, enhanced lighting, small size, and easy replacement can be obtained.

6 Claims, 4 Drawing Sheets

STRUCTURE OF LIGHTING BAR ASSEMBLY

FIELD OF THE INVENTION

The present invention relates to a structure of lighting bar assembly, and in particular to a structure that uses a connector to connect lighting bars and incorporates end caps and swivel seats to provide the advantages of tight engagement, being tough and durable, enhanced lighting brightness, and adjustable light projection angle for being applicable to various sites for lighting.

BACKGROUND OF THE INVENTION

Conventional lighting devices are widely used but suffer the drawbacks of high power consumption, which leads to waste of energy; high heat generation, which causes potential risk of burns of users and damage of the surrounding articles; short lifespan, which requires frequent replacement; easy breaking of glass-made light bulbs and tubes, which leads to difficult of preservation; and using mercury and fluorescent powders, which may cause potential risk to human body and environments; and monotonous style, which lacks sense of art.

However, the currently available LEDs still suffer the drawback of being structurally weak, which leads to deformation, detaching, breaking, and similar problems after long term use. Further, for the sites where high lighting brightness is needed, assembly of LED lighting devices is so far not available. Further, the costs of the LED lightings are high, which makes the prices of the LED lighting products available in the market correspondingly high, so as not to be accepted by the general consumers.

Thus, the present invention aims to provide a feasible design for overcoming the above problems.

SUMMARY OF THE INVENTION

A primary objective of the present invention is to provide a structure of a lighting bar assembly, wherein tight engagement is established between an enclosure of a lighting bar and end caps to ensure a tight coupling thereby enhancing practicability and improvement of the present invention.

Another objective of the present invention is to provide a structure of a lighting bar assembly having end caps made by injection molding and forming reinforcing ribs on circumferences thereof to provide the advantages of easy manufacturing, reduced costs, and being tough and durable thereby enhancing practicability and improvement of the present invention.

A further objective of the present invention is to provide a structure of a lighting bar assembly having lighting bars connected by a connector so as to allow flexible addition of extra lighting bars for raising lighting brightness thereby enhancing practicability and improvement of the present invention.

A further objective of the present invention is to provide a structure of a lighting bar assembly having lighting bars, which, after being connected with a connector, are mounted to two swivel seats at opposite ends of the assembly to provide the advantages of stably mounting the lighting bars and adjustability of light projection angles thereby enhancing practicability and improvement of the present invention.

A further objective of the present invention is to provide a structure of a lighting bar assembly wherein a power supply device is arranged inside an enclosure of a lighting bar to provide the advantages of reduced overall size of the lighting bar and easy replacement thereby enhancing improvement and convenience of the present invention.

Yet a further objective of the present invention is to provide a structure of a lighting bar assembly comprising a circuit board carrying various combinations of light-emitting diodes of various colors to decorate the surroundings and romanticize atmosphere thereby enhancing improvement and variability of the present invention.

To realize the above objectives, the present invention provides a structure of a lighting bar assembly, comprising at least two lighting bar and at least one connector. Each lighting bar of the at least two lighting bars comprises an enclosure, a circuit board, at least one power supply device, four male terminals, and two end caps. The enclosure is coupled to the circuit board. The circuit board comprises a plurality of light-emitting diodes. The enclosure forms an interior space receiving the at least one power supply device. Opposite ends of the enclosure are respectively closed by the two end caps with the two end caps being in tight engagement with the enclosure. Each end cap forms a connection window in which two through holes are provided. Each of the through holes receives an end of a respective one of the male terminals. Each male terminal, the at least one power supply device and the circuit board are in electrical connection with one another. The at least one connector is fit into the connection windows of the end caps of the at least two lighting bars. Each connector forms two through holes in which two female terminals are respectively fit and fixed for being electrically engageable with respective male terminals. Further, the lighting bars, after being connected with the connector, are provided with a swivel seat at each of two opposite ends thereof. As such, advantages of easy manufacturing, reduced costs, tight engagement, being tough and durable, enhanced lighting, adjustable light projection angle, small size, easy replacement, and decoration of the surroundings can be obtained.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
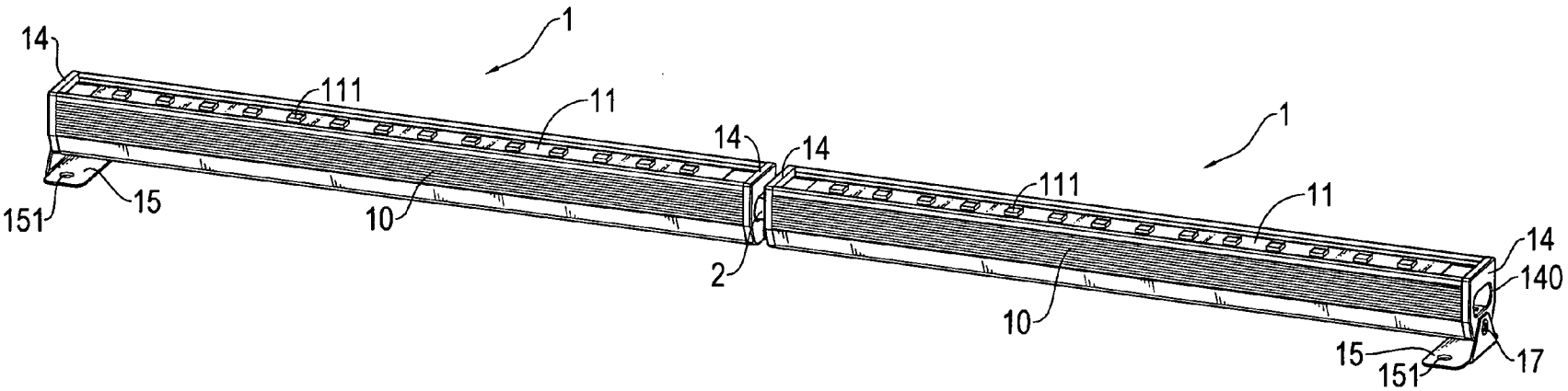
FIG. 1 is a perspective view of a lighting bar in accordance with the present invention.
Figure 2:
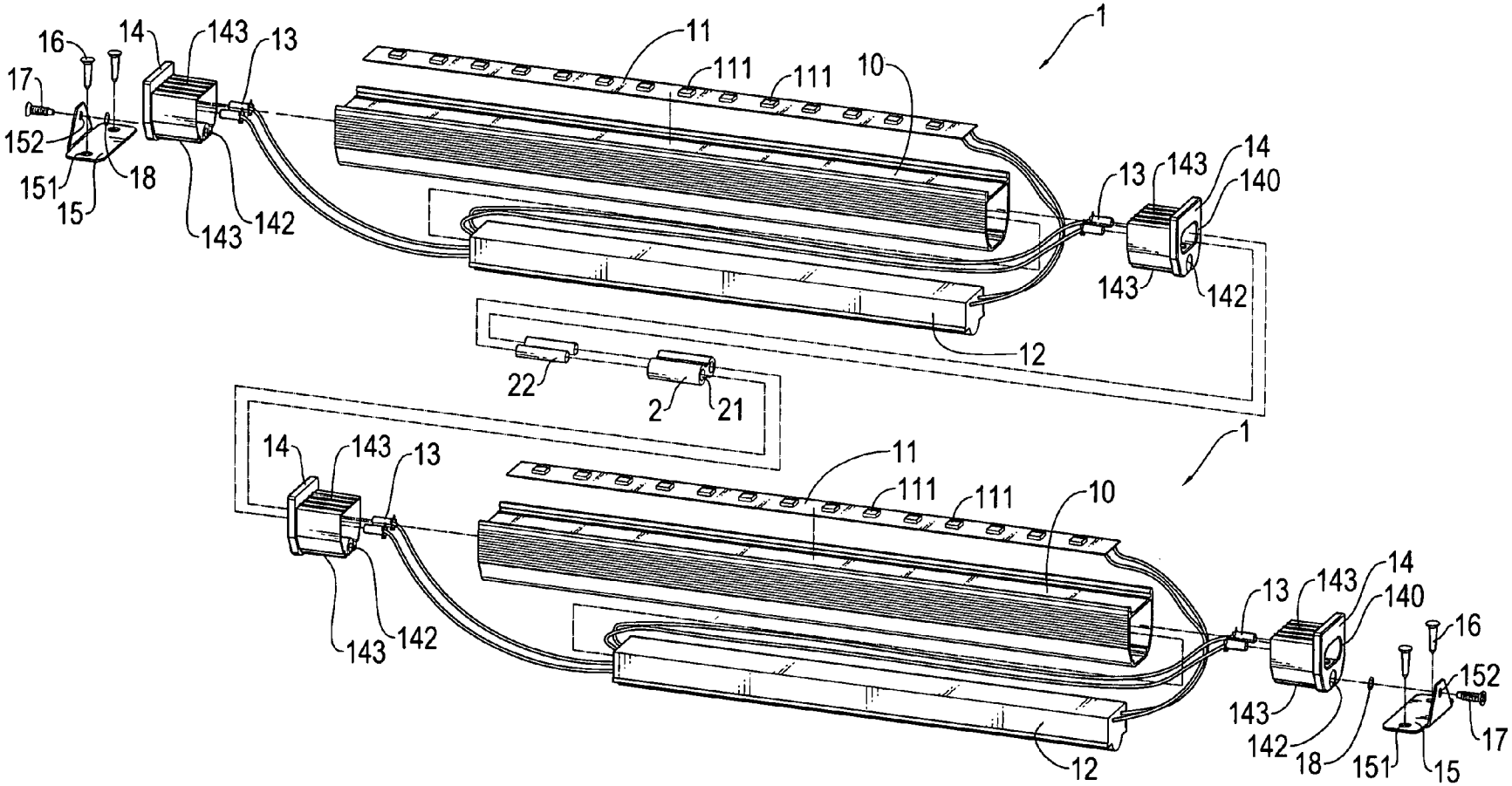
FIG. 2 an exploded view of a lighting bar assembly constructed in accordance with the present invention.
Figure 3:
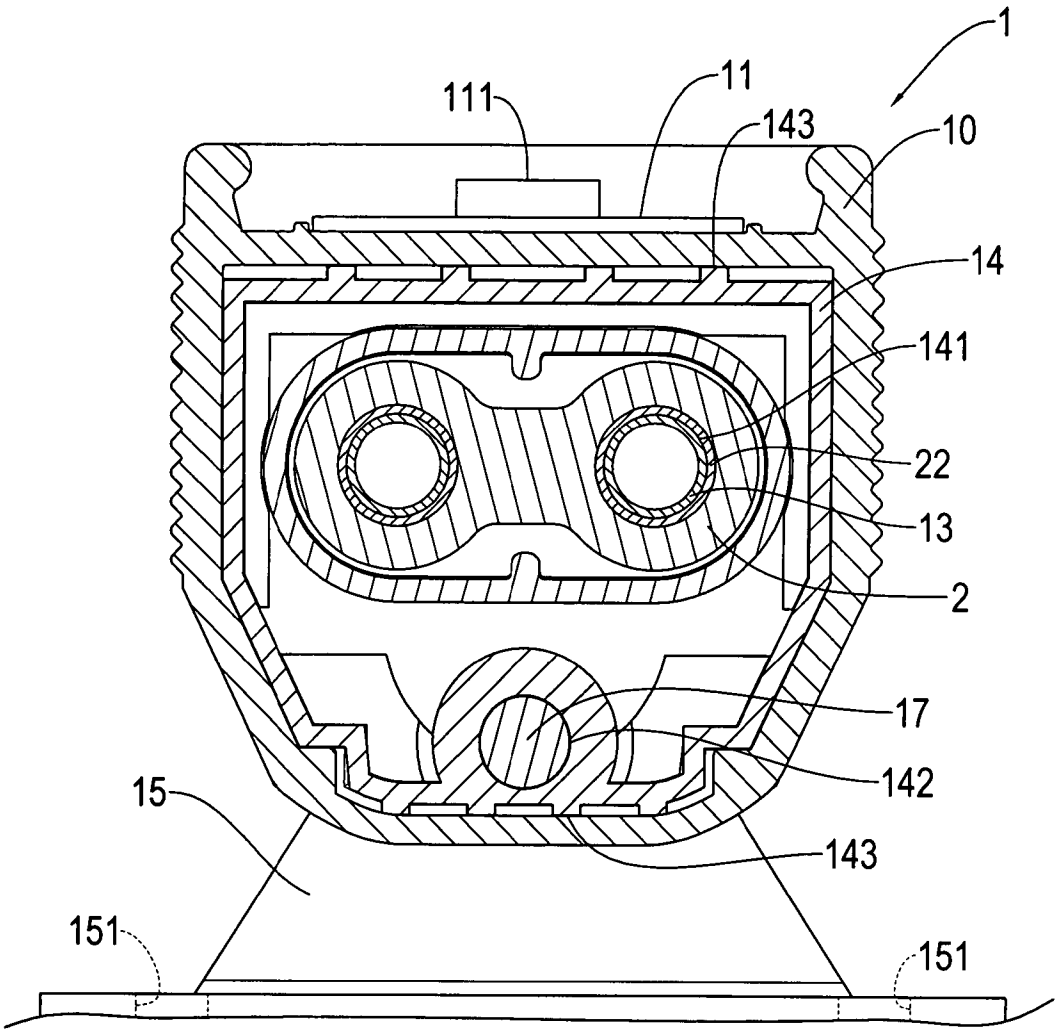
FIG. 3 is a cross-sectional view of the lighting bar assembly of the present invention.

With reference to FIGS. 1-3, which respectively show a perspective view of a lighting bar in accordance with the present invention, an exploded view of a lighting bar assembly constructed in accordance with the present invention, and a cross-sectional view of the lighting bar assembly of the present invention, the lighting bar assembly in accordance with the present invention comprises at least two lighting bars 1 and at least one connector 2.

Each lighting bar of the at least two lighting bars 1 comprises an enclosure 10, a circuit board 11, at least one power supply device 12, four male terminals 13, and two end caps 14. The enclosure 10 is injection molded and the enclosure 10 is coupled to the circuit board 11. The circuit board 11 comprises a plurality of light-emitting diodes (LEDs) 111 (which are white LEDs in the instant embodiment, but can be either red, blue, or green LEDs). The enclosure 10 forms an interior space receiving the at least one power supply device 12. Opposite ends of the enclosure 10 are respectively closed by the two end caps 14. The two end caps 14 are injection molded and each forms a connection window 140. The connection window 140 forms two through holes 141 therein and each through hole 141 receives an end of a respective one of the male terminals 13. Each male terminal 13, the at least one power supply device 12 and the circuit board 11 are all in electrical connection with one another (and in the instant embodiment, an opposite end of each male terminal 13 is electrically connected to the at least one power supply device 12 and the at least one power supply device 12 is electrically connected to the circuit board 11).

The at least one connector 2 is fit into the connection window 140 of an end cap 14 of the at least two lighting bars 1 and the at least one connector 2 each has two through holes 21. Two female terminals 22 are respectively fit into and fixed in the two through holes 21 and are electrically engageable with the respective male terminals 13.

Figure 4:
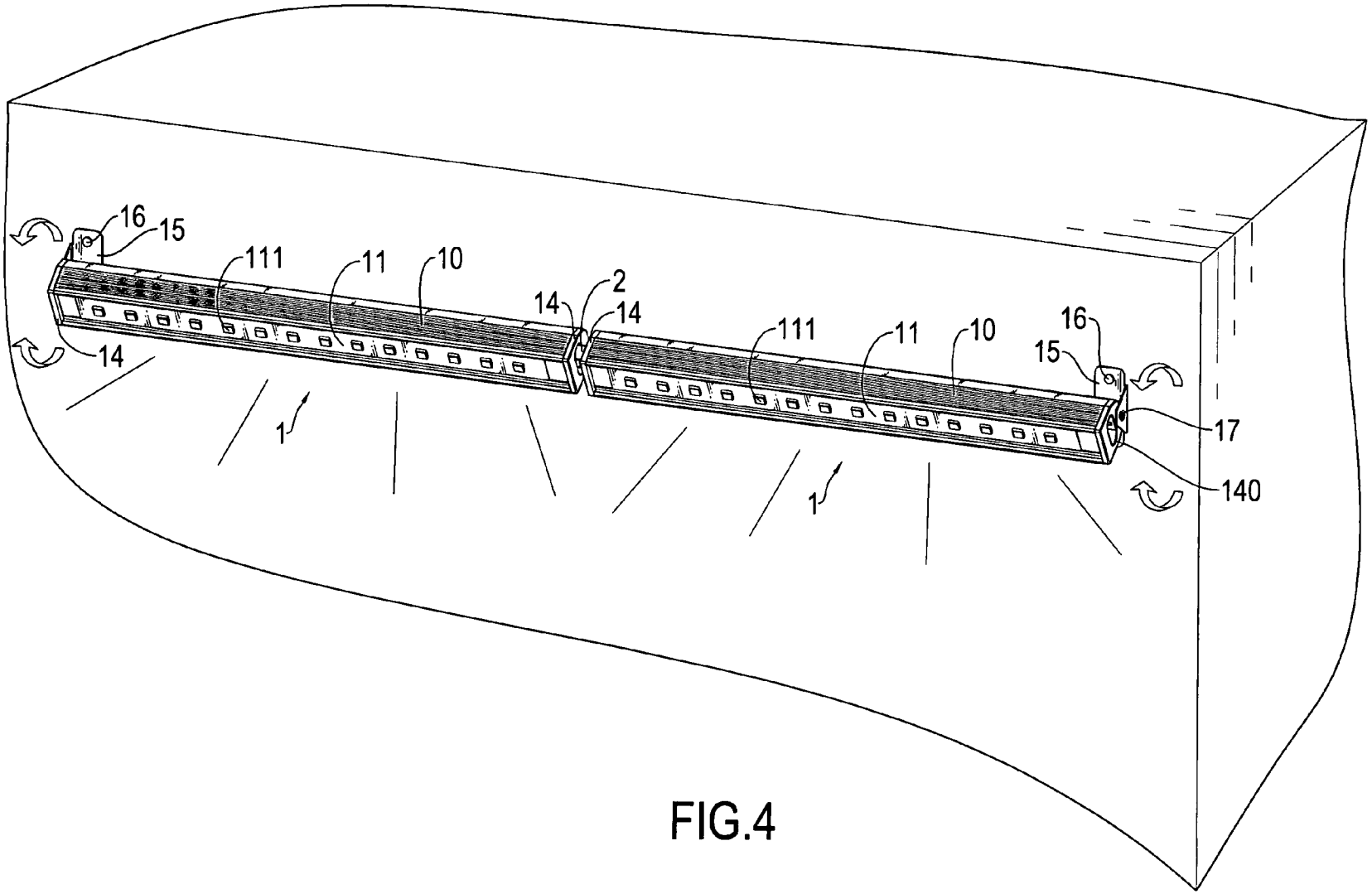
FIG. 4 shows an application of the lighting bar assembly of the present invention.

To use, as illustrated in FIG. 4, which shows an application of the lighting bar assembly of the present invention, opposite ends of the connector 2 are respectively fit to the connection windows 140 of the end caps 14 of the two lighting bars 1 to have the female terminals 22 of the connector 2 electrically engaging the respective male terminals 13 of the lighting bars 1. The two lighting bars 1, after being so connected, are mounted to a swivel seat 15 at each end. Each swivel seat 15 comprises a bent plate having a bottom section defining two mounting holes 151. Nails 16 (or steel nails, screws or other fasteners that can extend through the mounting holes 151 for fixing) can be put through the two mounting holes 151 of the swivel seat 15 to provide fixing and positioning to the lighting bars 1 that are connected together. Each swivel seat 15 has a side section forming a locking hole 152 and the end cap 14 of each lighting bar 1 also forms a locking hole 142. A bolt 17 is used to secure the locking holes 142, 152 of the end cap 14 and the swivel seat 15. Further, an O-ring 18 is set between the end cap 14 and the swivel seat 15 to allow the lighting bar 1 to be rotatable so as to adjust the projection angle of light. When power is supplied from an external source, the LEDs 111 of the two lighting bars 1 are immediately lit up and project sufficient lighting brightness. By rotating the lighting bars 1, the projection angle of light is adjusted and the area where the light radiates is also changed, whereby sufficient flexibility and variation are realized.

It is particularly noted that the end caps 14 in accordance with the present invention are injection moldings, which can be easily manufactured with reduced costs of material and manufacturing and can tightly engage the enclosure 10 without being easily detached. Further, the end cap 14 is provided, on a circumference thereof, with a plurality of reinforcing ribs 143 to make the end cap 14 tough, durable and difficult to deform. Further, the use of the connector 2 allows addition of lighting bars 1 in a flexible manner for increasing lighting brightness. Further, the power supply device 12 in accordance with the present invention is arranged inside the lighting bar 1, this being different from the conventional or currently available lighting bar where the power supply device is arranged outside the lighting bar, so that improved integration, reduced overall size, and easy replacement can be realized. Besides, the LEDs 111 can be arranged as a combination of various color lights (such as white light, red light, blue light, green light or combinations of two or more of the above listed lights), whereby a colorful lighting that shows various colors can be generated for decorating the surroundings and romanticizing the atmosphere, this being an important aspect of the present invention. It is apparent that the arrangement of the lighting bars 1 of the present invention can be in the longitudinal direction, or the lateral direction, or the diagonal direction, or any other orientations to provide various visual effects. Or, additional swivel seats 15 can be provided for supporting the end caps 14 located between adjacent lighting bars 1 to more stably mount the lighting bars 1.

The structure of lighting bar assembly in accordance with the present invention features that tight engagement is formed between the enclosure 10 and the end cap 14 to provide a firm coupling and thus enhancing practicability and improvement of the present invention, that the end caps 14 are injection molded and are provided with reinforcing ribs 143 on the circumferences thereof to provide the advantages of easy manufacturing, reduced costs, and being tough and durable to thereby enhance practicability and improvement of the present invention, that the lighting bars 1 are connected together with the connector 2 to allow for flexible addition of extra lighting bars 1 and raise lighting brightness to thereby enhance improvement of the present invention, that the lighting bars 1, after being assembled with the connector 2, are provided with swivel seats 15 at opposite ends to stably mount the lighting bars 1 and provide adjustability of light projection angle to thereby enhance practicability and improvement of the present invention, that the power supply device 12 is arranged inside the enclosure 10 of the lighting bar 1 to reduce the overall size of the lighting bar 1 and to allow for easy replacement thereby enhancing practicability and improvement of the present invention, that the LEDs 111 mounted to the circuit board 11 may include combinations of various color lights to decorate the surroundings and romanticize atmosphere thereby enhancing practicability and improvement of the present invention. As discussed above, the structure of lighting bar assembly possesses practicability, improvement, convenience, and variability.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A lighting bar assembly, comprising:

at least two lighting bar, each comprising an enclosure, a circuit board, at least one power supply device, four male terminals, and two end caps, wherein the enclosure is coupled to the circuit board, the circuit board comprises a plurality of light-emitting diodes, the enclosure forms an interior space receiving the at least one power supply device, opposite ends of the enclosure are respectively closed by the two end caps with the two end caps being in tight engagement with the enclosure, each end cap forms a connection window in which two through holes are provided, each through hole receives an end of a respective one of the male terminals, and each male terminal, the at least one power supply device and the circuit board are in electrical connection with one another; and at least one connector, which is fit into the connection windows of the end caps of the at least two lighting bars, the connector forming two through holes in which two female terminals are respectively fit and fixed for being electrically engageable with respective male terminals.

2. The lighting bar assembly as claimed in claim 1, wherein the enclosures of the lighting bars are injection moldings.

3. The lighting bar assembly as claimed in claim 1, wherein the end caps of the lighting bars are injection moldings.

4. The lighting bar assembly as claimed in claim 1, wherein the end caps form reinforcing ribs on circumferences thereof to strengthen the end caps.

5. The lighting bar assembly as claimed in claim 1, wherein the lighting bars 1, after being connected with the at least one connector, are provided with a swivel seat, a bolt, and an O-ring at each of opposite ends, each swivel seat comprising a bent plate having a bottom section defining two mounting holes for securely mounting and a side section forming a locking hole, the end cap of each lighting bar forming a locking hole, the bolt securing the locking holes of the end cap and the swivel seat, the O-ring being set between the end cap and the swivel seat to allow for adjustment of projection angle of light.

6. The lighting bar assembly as claimed in claim 1, wherein an opposite end of each male terminal is electrically connected to the at least one power supply device and the at least one power supply device is electrically connected to the circuit board.

* * * * *